US006737598B1

(12) United States Patent
Allen et al.

(10) Patent No.: US 6,737,598 B1
(45) Date of Patent: May 18, 2004

(54) ELECTRICAL SWITCH WITH LIMITED CONTACT ARCING

(75) Inventors: David G. Allen, Toronto (CA); Mehmet U. Sayman, Scarborough (CA); Liviu N. Dan, Kitchener (CA)

(73) Assignee: Tyco Electronics Canada, Ltd., Markham (CA)

( * ) Notice: Subject to any disclaimer, the term of this patent is extended or adjusted under 35 U.S.C. 154(b) by 0 days.

(21) Appl. No.: 10/316,757

(22) Filed: Dec. 11, 2002

(51) Int. Cl.[7] ..... H01H 15/00
(52) U.S. Cl. ..... 200/537; 200/538; 200/548
(58) Field of Search ..... 200/537, 538, 200/539, 540, 541, 542, 547, 548, 549, 550, 303, 383

(56) References Cited

U.S. PATENT DOCUMENTS 1,169,099 A * 1/1916 Wilcox et al.
5,369,237 A 11/1994 Mejerl et al.
5,426,274 A * 6/1995 Briiggemann et al. ..... 200/447
5,798,584 A 8/1998 Schaeffeler et al.
6,104,105 A 8/2000 Schaeffeler et al.

* cited by examiner

*Primary Examiner*—Lincoln Donovan
*Assistant Examiner*—K. Lee

(57) ABSTRACT

An electrical switch is provided that includes a housing having at least one contact retention chamber formed therein. The housing includes an opening in one wall of the contact retention chamber through which an actuator is extended. A contact assembly is movably mounted within the contact retention chamber of the housing. The contact assembly has at least one contact that is movable along an arcuate path aligned at an angle to the longitudinal axis of the housing. The actuator includes an insulated over-molded portion that retains a conductive member therein. The conductive member is configured to engage the contact. The housing slidably retains the actuator to permit movement of the actuator and the conductive member along the longitudinal axis of the housing. The actuator drives the contacts along the arcuate path between engaged and disengaged positions with the conductive member as the actuator moves along the longitudinal axis of the housing.

20 Claims, 7 Drawing Sheets

ELECTRICAL SWITCH WITH LIMITED CONTACT ARCING

BACKGROUND OF THE INVENTION

The present invention generally relates to an electrical switch for use in high current and high voltage applications. More particularly, certain embodiments of the present invention relate to an electrical switch that reduces arcing when contacts make and break connections.

A wide variety of electrical switches have been proposed for various industrial and commercial applications. Some examples of industrial and commercial applications relate to power tools, electric motors, heating and air conditioning systems, and the like. These varied electrical switches are adapted to operate in high current and/or high voltage applications, as well as with AC and/or DC power supplies.

In general, electrical switches used in high current and high voltage applications include a contact carriage that is moveable within a switch housing. The contact carriage carries contacts that make and break electric connections with associated contacts mounted in the switch housing. FIG. 1 illustrates a top isometric view of a conventional switch housing 10 and a contact carriage 12 removed therefrom. The contact carriage 12 is configured to be moveably mounted within the switch housing 10. The switch housing 10 includes side walls 5, end walls 7 and a bottom 9 that collectively define an interior chamber 11. The switch housing 10 includes contact posts 14 and 15 that are rigidly mounted within the chamber 11 and located proximate front and rear ends 42 and 43, respectively, of the switch housing 10. The contact posts 14 and 15 include faces 16 and 19, respectively, directed toward one another. The bottom 9 of the switch housing 10 is formed with parallel ribs 13 extending between the front and rear ends 42 and 43 of the switch housing 10. A space between the ribs 13 forms a channel 15 that similarly extends between the front and rear ends 42 and 43. The side walls 5 include stepped interior surfaces 3 that are cut by a notch 17 which extends laterally across the interior chamber 11. The notch 17 extends through the ribs 13 and through the channel 15.

The contact carriage 12 includes a body 26 that extends along a longitudinal axis 22. The body 26 includes a front face 21. The contact carriage 12 is configured to be inserted into the chamber 11 of the switch housing 10 with the front face 21 of the contact carriage 12 turned to face the bottom 9 of the switch housing 10. With reference to FIG. 1, before insertion into the switch housing 10, the contact carriage 12 as shown FIG. 1 is rotated 180 degrees about the longitudinal axis 22 until the front face 21 of the contact carriage 12 faces the bottom 9 of the switch housing 10.

The body 26 of the contact carriage 12 includes support posts 28 and 34 formed on the front face 21 proximate opposite ends of the body 26. A pair of C-shaped supports 30 and 32 are also provided on the front face 21 of the body 26 and arranged to face in opposite directions along the longitudinal axis 22. The C-shaped supports 30 and 32 are positioned near corresponding support posts 28 and 34. The support post 28 and the C-shaped support 30 are separated by a gap that receives a contact bridge 18. The support post 34 and C-shaped support 32 are separated by a gap that receives contact bridge 20. Contact bridges 18 and 20 are oriented parallel to one another and transverse to the longitudinal axis 22. The C-shaped supports 30 and 32 receive springs 36 and 37, respectively, that bias contact bridges 18 and 20, respectively, outward against support posts 28 and 34. The contact bridges 18 and 20 include contact pads 24 and 25, respectively, facing outward in opposite directions. The contact bridges 18 and 20 are permitted to move along the longitudinal axis 22 within a limited range of motion.

The support posts 28 and 34 include tip portions 29 and 35, respectively, extending upward away from the front face 21. When the contact carriage 12 is loaded into the chamber 11, the contact tips 29 and 35 are turned down to rest in, and slide along, the channel 15 formed between the ribs 13. Hence, ribs 13 and tip portions 29 and 35 cooperate to control the direction of motion of the contact carriage 12 with respect to the switch housing 10 during operation. Once the contact carriage 12 is loaded into the chamber 11, the contact bridges 18 and 20 are aligned with contact posts 14 and 15, respectively, such that pads 24 on contact bridge 18 align with faces 16 on contact posts 14. Similarly, pads 25 on contact bridge 20 align with faces 19 on contact posts 15. As the contact carriage 12 is slid in the direction of arrow A, pads 24 engage faces 16 to form an electrical connection through contact bridge 18 and between contact posts 14. When the contact carriage 12 is slid in the direction of arrow B, pads 25 engage faces 19 to afford an electrical connection through contact bridge 20 between contact posts 15. Only one of contact bridges 18 and 20 is electrically connected with the corresponding contact posts 14 and 15, respectively, at any single point in time. Hence, when contact bridge 18 engages contact posts 14, contact bridge 20 is disengaged from contact posts 15, and vice versa.

FIG. 2 illustrates a partial end isometric view of the contact carriage 12 to better illustrate a dielectric hood 46 mounted on the body 26. The dielectric hood 46 is configured to reduce arcing by separating the contact bridge 20 from the contact posts 15 when the contact carriage 12 is moved in the direction of arrow A. The dielectric hood 46 includes a central beam 48 located above, and extending parallel to, the contact bridge 20. Opposite ends 47 of the central beam 48 are held within notch 17 (FIG. 1) in the stepped interior surfaces 3 of the side walls 5. The central beam 48 is slidably mounted to legs 49 provided on the body 26. The notch 17 holds the central beam 48 at a fixed position in the chamber 11. Hence, when the contact carriage 12 moves within chamber 11, the dielectric hood 46 moves relative to the body 26.

A pair of isolation flaps 50 and 52 are mounted on opposite ends of the central beam 48 proximate the pads 25 (shown in dashed lines in FIG. 2) on opposite ends of the contact bridge 20. The isolation flaps 50 and 52 are curved in an L-shape as shown in FIG. 2 to extend forwardly from the central beam 48 and to curve downward toward the body 26. When the central beam 48 is moved in the direction of arrow C with respect to the body 26, the central beam 48 rotates in the direction of arrow D until the isolation flaps 50 and 52 cover the pads 25 on the front of the contact bridge 28. When the central beam 48 is moved in the direction of arrow E with respect to the body 26, the central beam 48 is rotated in the direction of arrow F, causing the isolation flaps 50 and 52 to pivot upward to expose the pads 25 on the contact bridge 20. FIG. 1 illustrates the dielectric hood 46 moved to a position at which the contact bridge 20 and the pads 25 are entirely exposed to faces 19 on the contact posts 15.

Returning to FIG. 1, when the contact carriage 12 is loaded into the switch housing 10, opposite ends 47 of the central beam 48 are received within the notch 17. As the contact carriage 12 is moved in the direction of arrow A, the notch 17 holds the central beam 48 in a fixed position relative to the switch housing 10, thereby causing the relative motion between the dielectric hood 46 and the body 26 of the contact carriage 12 in the direction of arrow C (FIG. 2) which in turn causes the central beam 48 to rotate in the direction of arrow D to cover pads 25 on the contact bridge 20 with the isolation flaps 50 and 52. In reverse, when the contact carriage 12 is moved in the direction of arrow B (FIG. 1), the notches 17 continue to retain the central beam 48 at a fixed location relative to the switch housing 10. As the contact carriage 12 is moved in the direction of arrow B, the body 26 and dielectric hood 46 experience relative motion therebetween in the direction of arrow E which in turn causes the central beam 48 to rotate in the direction of arrow F. Rotating the central beam 48 in the direction of arrow F moves the isolation 50 and 52 upward away from the contact bridge 20 to expose the pads 25 to the faces 19.

The foregoing conventional structure provides a high current and/or high voltage switching mechanism.

However, conventional switches, such as the switch shown in FIGS. 1 and 2, have met with limited success. In particular, conventional electrical switches continue to experience an unduly large amount of arcing in high current and/or high voltage applications. There remains a tendency for arcing to occur during making and breaking of connections between the contact pads 24 and 25 and faces 16 and 17 on contact posts 14 and 15, respectively. Each time an arc occurs, a carbon residue is left on the faces 16 and 17 of the contact posts 14 and 15 and upon the contact pads 24 and 25. In addition, each time an arc occurs, the risk exists that small divots may be burned or chipped into the faces 16 and 17 and/or contact pads 24 and 25. Carbon buildup and divots create a rough interface between the contact pads 24 and 25 and faces 16 and 17. As this interface becomes more uneven and as more carbon builds up, the electrical switch exhibits higher internal resistance which causes the switch to heat up during operation. Undue heating of the electrical switch may damage the switch and detract from its useful life.

A need remains for an improved electrical switch that reduces carbon buildup and surface divots at the contact interface, in order to extend the overall operating life and current/voltage carrying capacity of the electrical switch.

BRIEF SUMMARY OF THE INVENTION

An electrical switch is provided that includes a housing having at least one contact retention chamber formed therein. The housing includes an opening through one wall of the contact retention chamber through which an actuator extends. A contact assembly is movably mounted within the contact retention chamber of the housing. The contact assembly includes contacts that are movable along an arcuate path aligned at an angle to a longitudinal axis of the housing. The actuator includes an insulated over-molded portion that retains a conductive member therein. The conductive member is configured to engage the contacts. The housing slidably retains the actuator to permit movement of the actuator and the conductive member along the longitudinal axis of the housing. The actuator drives the contacts along the arcuate path between engaged and disengaged positions with the conductive member as the actuator moves along the longitudinal axis of the housing drives.

Optionally, the contact assembly may include first and second sets of contacts that are configured such that the first set of contacts is normally open, while the second set of contacts is closed when the switch is an OFF position. When either set of contacts is closed, it engages opposite sides of the conductive member to convey power through the conductive member between the closed set of contacts.

Optionally, the housing may include first and second contact retention chambers separated by an insulated divider. The insulated divider includes an opening therethrough that slidably receives the conductive member. The conductive member moves back and forth through the divider between the first and second contact chambers to engage one of the first and second sets of contacts. When the conductive member is located in the first contact chamber, the contacts in the second contact chamber are open and electrically isolated from one another by an intervening dielectric member, and vice versa.

The actuator may include one or more grooves cut in its exterior and aligned with corresponding elbows bent into the bodies of the contacts. The grooves and elbows cooperate to bias the contacts outward away from the actuator along the arcuate path as the actuator is slidably moved along the longitudinal axis of the housing. The contacts travel along the arcuate path at a first instantaneous rate of movement and the actuator moves along the longitudinal axis of the housing at a different second instantaneous rate of movement. By using different first and second instantaneous rates, the actuator increases the rate at which the contacts are moved toward and away from the conductive member with respect to the rate at which the actuator is moved along the housing.

Figure 1:
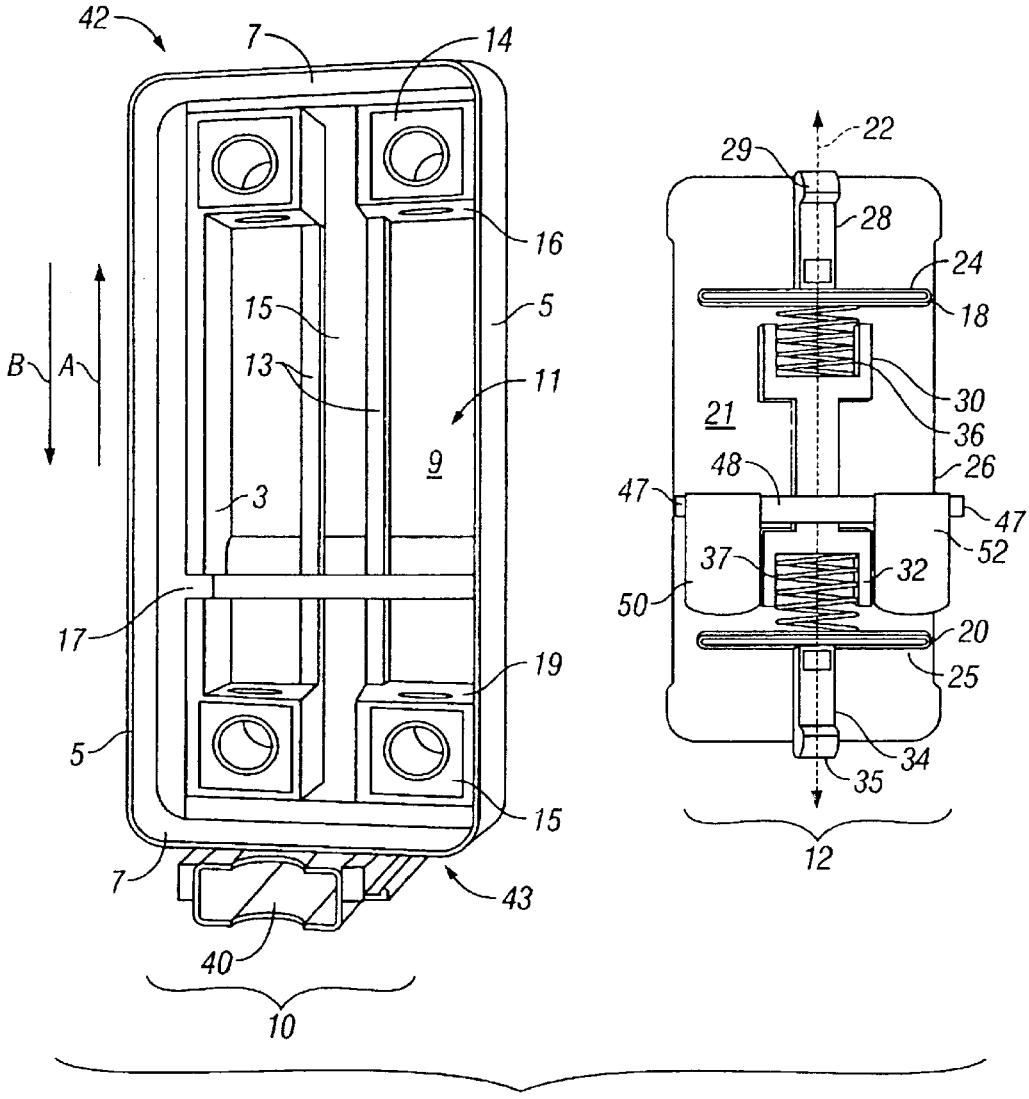
FIG. 1 (Prior Art)
FIG. 1 illustrates a top isometric view of a conventional switch housing and contact carriage.
Figure 2:
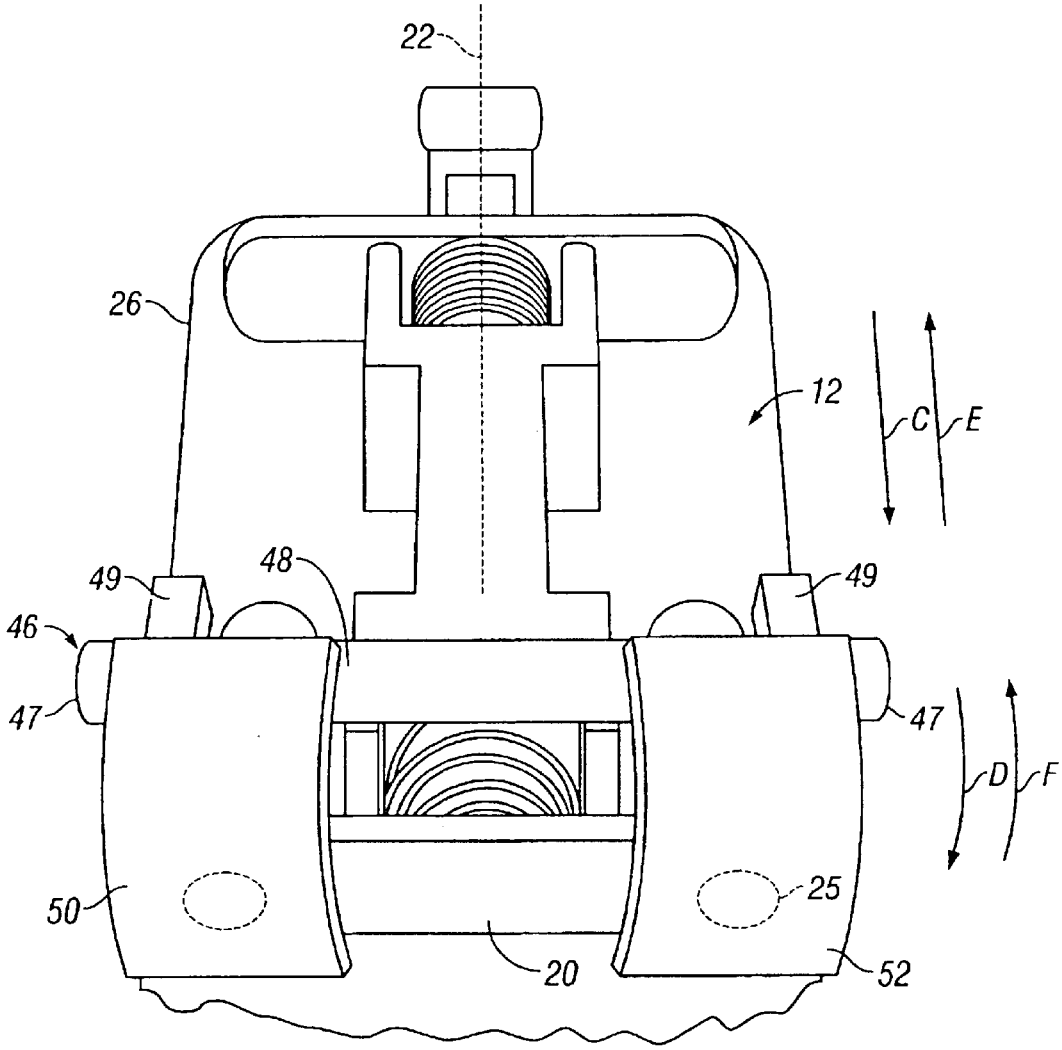
FIG. 2 (Prior Art)
FIG. 2 illustrates a partial end isometric view of a conventional contact carriage.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

Figure 3:
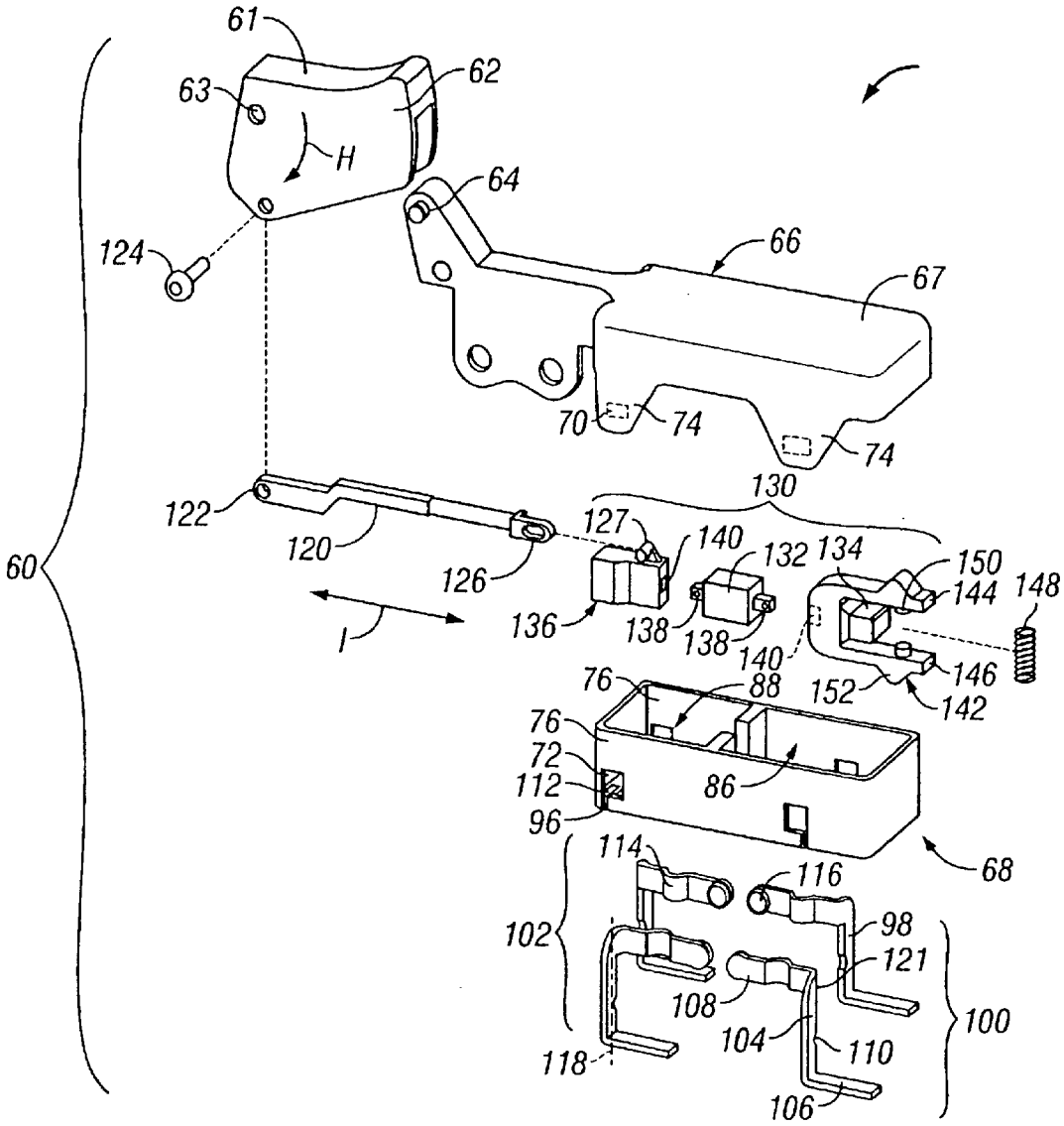
FIG. 3 illustrates an exploded isometric view of an electrical switch formed in accordance with an embodiment of the present invention.

FIG. 3 illustrates an exploded view of an electrical switch 60 formed in accordance with an embodiment of the present invention. The electrical switch 60 includes a trigger 62 having a hole 63 that is rotatably mounted at hinge pin 64 to an upper shell 66 of the electrical switch 60. A user squeezes the trigger 62 at surface 61 to rotate the trigger 62 in the direction of arrow H. The upper shell 66 is mounted over a housing base 68 and snapably retained thereon by latch projections 70 that are securely received within openings 72 in the housing base 68. In the illustration of FIG. 3, one side of the upper shell 66 is illustrated to include a pair of limbs 74 extending downward therefrom. Each limb 74 includes one of the latching projections 70 on its interior surface (denoted in dashed lines). It is to be understood that a similar pair of limbs 74 are formed on the back side of the upper shell 66 (although not shown). The housing base 68 includes multiple openings 72 arranged along opposite sides 76 and positioned to align with the latch projections 70.

Figure 4:
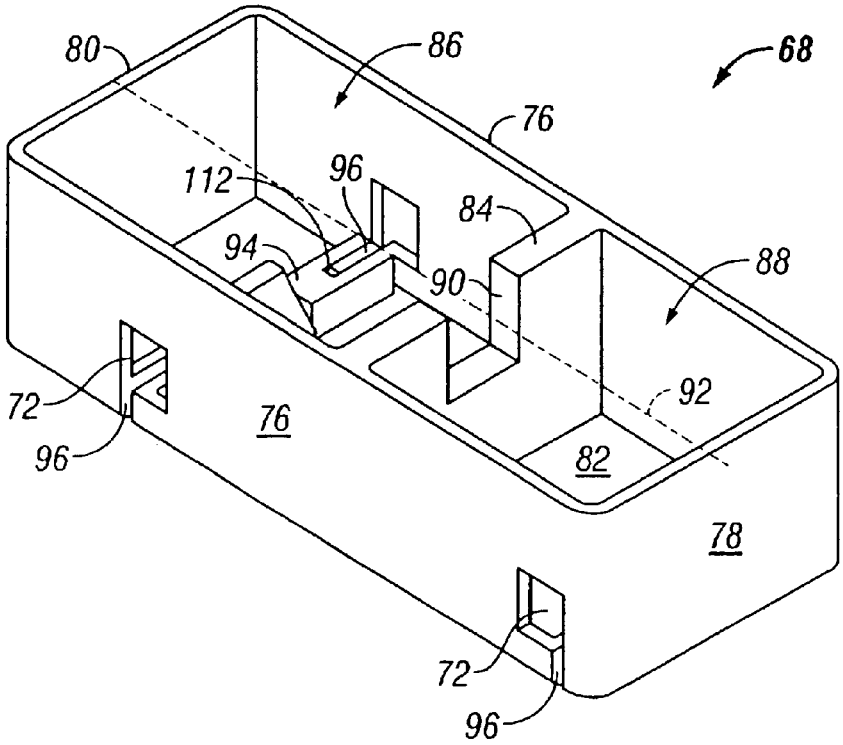
FIG. 4 illustrates a top isometric view of a housing base formed in accordance with an embodiment of the present invention.

As shown in FIG. 4, the housing base 68 includes front and rear end walls 78 and 80 and a bottom wall 82. The housing base 68 also includes a central divider 84 separating the housing base 68 into first and second chambers 86 and 88. The divider 84 includes a notched opening 90 cut therein to afford a path of communication between the first and second chambers 86 and 88. The housing base 68 has a longitudinal axis 92. The bottom wall 82 is molded with block portions 94 on the interior surface thereof. The block portions 94 are formed proximate to, and extend laterally inward from, the openings 72 into the first and second chambers 86 and 88. Each opening 72 is joined by a slot 96 cut downward through the block portions 94 and bottom wall 82. As explained below in more detail, the openings 72 enable contacts to be loaded into the first and second chambers 86 and 88, while slots 96 securely retain the contacts once loaded.

Returning to FIG. 3, the electrical switch 60 also includes a plurality of contacts 98 arranged in first and second contact sets 100 and 102. Each contact 98 includes a base portion 104 joined at a right angle on one end, with a contact tail 106 and on the opposite end by a contact arm 108. The base 104, contact tail 106, and contact arm 108 are joined in a stepped manner at right angles in the preferred embodiment. However, alternative contact designs may be utilized. The base portion 104 of each contact 98 includes a notch 110 formed in a side thereof. The contacts 98 may be loaded in through the exterior of openings 72 or outward from the interior of openings 72. Once the contacts 98 are inserted through the openings 72, the base portions 104 are firmly pressed into slots 96 until notches 110 seat against the interior end 112 of the corresponding slot 96. In this manner, the contacts 98 are firmly and frictionally held within the first and second chambers 86 and 88.

The contact arms 108 each include an intermediate elbow 114 bent to be directed inward toward the center or longitudinal axis 92 (FIG. 4) of the housing base 68. The outer ends of the contact arms 108 include contact pads 116 that are aligned to face inward toward the longitudinal axis 92 (FIG. 4). The contact pads 116 and elbows 114 on contacts 98 in the first contact set 100 align with and face one another as do the contact pads 116 and elbows 114 in the second contact set 102.

The base portions 104 may be flexible such that when held firmly within notches 96, the base portions 104 define axes of rotation 118 about which the contact arms 108 may pivot. The contact tails 106 are configured to be connected to external wires that supply power to the electrical switch 60 and draw power from the electrical switch 60. The contact 98 permits rotation of each contact arm 108 along an arcuate path about rotational axis 118 by twisting the base portion 104 and/or a limited amount of flex at corner 121 where the contact arm 108 and base portion 104 intersect.

The electrical switch 60 also includes a plunger 120 having a hole 122 through one end thereof. The plunger 120 is pivotally mounted by a pin 124 to the trigger 62. The plunger 120 includes an elongated hole 126 in an end opposite to the hole 122. The elongated hole 126 receives a pin 127 formed on an actuator assembly 130. As the trigger 62 is depressed in the direction of arrow H or released in the opposite direction, the trigger 62 pivots about hinge pin 64 which in turn drives the plunger 120 in directions denoted by arrow I.

The actuator assembly 130 includes a conductive member 132 centrally located between lead and trailing dielectric members 134 and 136. The conductive member 132 includes pins 138 extending from opposite ends thereof that are configured to be received in holes 140 formed in adjacent faces of the lead and trailing dielectric members 134 and 136. The hole 140 in the lead dielectric member 134 is denoted in dashed lines. The lead dielectric member 134 is provided with a trigger advancing mechanism 142 (integrally or separately). The structure and operation of the trigger advancing mechanism is discussed below in more detail in connection with FIG. 8. The trigger advancing mechanism 142 facilitates and increases the speed with which the actuator assembly 130 is moved along the longitudinal axis 92 between on and off switch positions or states once the trigger 62 is squeezed to an intermediate transition point along the range of motion for the trigger 62.

Figure 5:
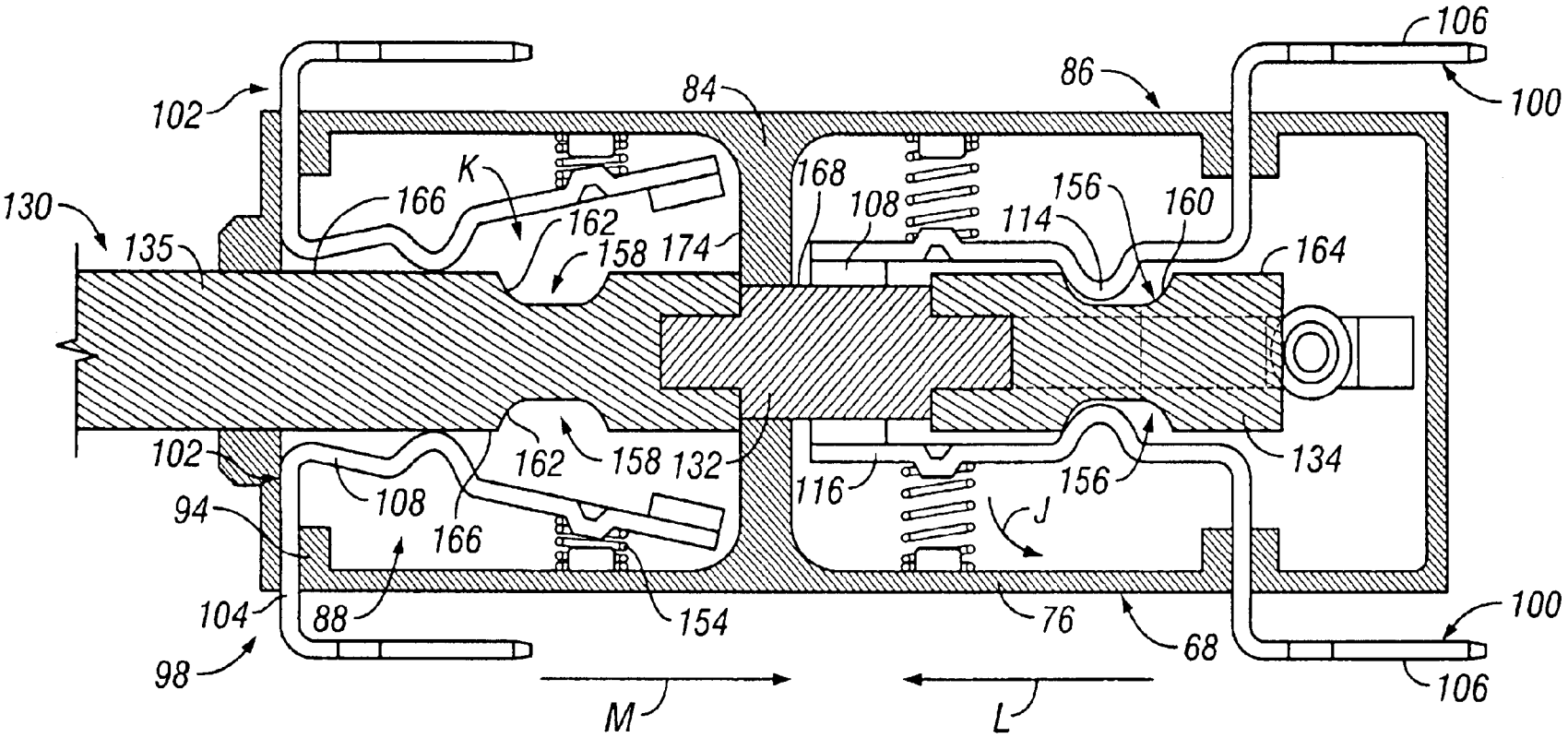
FIG. 5 illustrates a top sectional view of an electrical switch formed in accordance with an embodiment of the present invention when in a rest/disengaged position or state.
Figure 6:
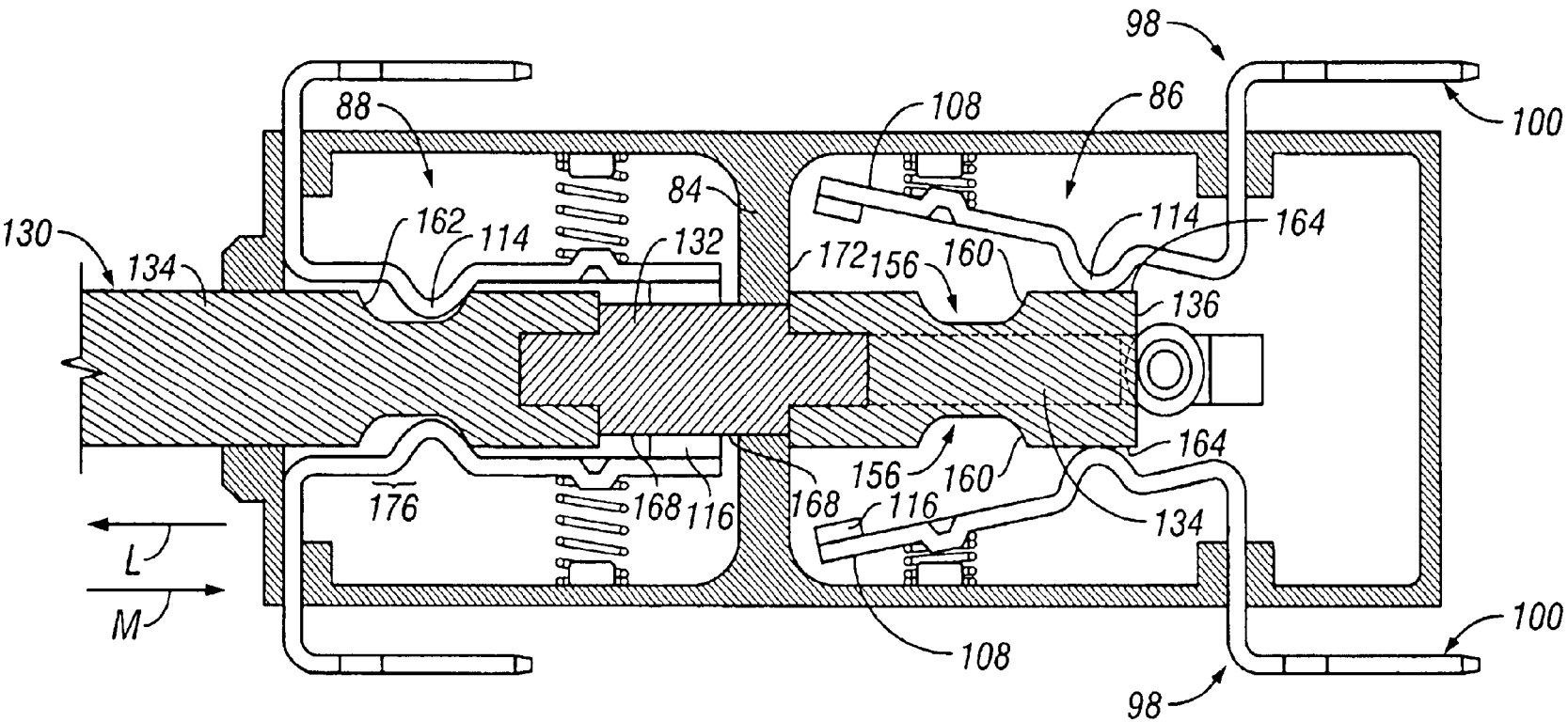
FIG. 6 illustrates a top sectional view of an electrical switch formed in accordance with an embodiment of the present invention when in an ON/engaged position or state.

FIGS. 5 and 6 illustrate top sectional views of the electrical switch 60 when in an OFF position (FIG. 5) and in an ON position (FIG. 6). The electrical switch 60 is configured such that the first contact set 100 operates in a normally closed position in which the first contact set 100 engages the conductive member 132 when the trigger 62 is in the OFF position. The second contact set 102 operates in a normally open position (as shown in FIG. 5) (e.g., disengaged from the conductive member 132) when the trigger 62 is in the OFF position (e.g., not pressed). When the trigger 62 is pressed, the first and second contact sets 100 and 102 change states (as shown in FIG. 6).

With reference to FIG. 5, each base portion 104 is securely held within a corresponding block portion 94. The contact arms 108 may be biased inward along an arcuate path as denoted by arrow J through the use of springs 154 provided between the contact arms 108 and the sides 76 of the housing base 68. Optionally, the springs 154 may be removed entirely and the internal normal forces created with the contact 98 solely relied upon to bias the contact arms 108 inward.

The lead and trailing dielectric members 134 and 136 have sides 164 and 166 with grooves 156 and 158 formed therein, respectively. In the example of FIG. 5, the lead and trailing dielectric members 134 and 136 each include a pair of grooves 156 and 158, respectively, aligned across from one another on opposite sides of the lead and trailing dielectric members 134 and 136. Each of grooves 156 and 158 includes at least one ramped surface 160 and 162, respectively, that forms a transition region between the deepest portion of the corresponding groove 156 and 158 and sides 164 and 166, respectively. More specifically, with reference to the first chamber 86, the ramped surface 160 forms a transition area between the side 164 of the lead dielectric member 134 and the bottom portion of the groove 156. As the actuator assembly 130 is moved in the direction of arrow L, the elbow 114 on the corresponding contact 98 rides from the depth of the groove 156, along ramped surface 160 onto side 164. Grooves 156 and elbows 114 cooperate to rotate the contact arm 108 along an arcuate path (denoted by arrow J) outward away from the sides 168 of the conductive member 132.

Similarly, the trailing dielectric member 136 includes grooves 158 having at least one ramped surface 162 forming a transition between each groove 158 and corresponding sides 166 of the trailing dielectric member 136. As the actuator assembly 130 moves in the direction of arrow L, the elbows 114 on corresponding contacts 98 ride along sides 166 and downward along ramped surfaces 162 into groove 158, thereby permitting the contact 98 to rotate inward along arrow K.

FIG. 6 illustrates a top sectional view of the electrical switch 60, in which the actuator assembly 130 has been moved in the direction of arrow L to the ON position (corresponding to when the trigger 62 is fully squeezed). When the lead and trailing dielectric members 134 and 136 are moved to the ON position, elbows 114 on the first contact set 100 rest on sides 164, thereby causing the contact arms 108 to pivot outward along an arcuate path away from the conductive member 132. The elbows 114, grooves 156 and ramped surfaces 160 may be dimensioned such that the speed or rate of motion at which the contact arms 108 pivot outward is greater than the speed or rate of motion at which the actuator assembly 130 moves linearly in the direction of arrow L. This enables the contact pads 116 to be quickly moved away from the sides 168 of the conductive member 132 in order to minimize the time during which the potential for arcing exists. In addition, as the contacts 98 in the first chamber 86 are disengaged from the conductive member 132, the conductive member 132 is moved through the divider 84 into the second chamber 88 until the lead dielectric member 134 abuts against the surface 172 of the divider 84. By abutting the lead dielectric member 134 against the surface 172 of the divider 84the conductive member 132 is entirely electrically isolated from the contacts 98 in the first chamber 86.

Returning to FIG. 5, when the trigger 62 is released, the actuator assembly 130 moves in the direction of arrow M. The conductive member 132 is moved through divider 84 into the first contact chamber 86 until the trailing dielectric member 136 abuts against the surface 174 of the divider 84 thereby entirely electrically isolating the contacts 98 in the second chamber 88 from the conductive member 132 and from one another. By utilizing lead and trailing dielectric members 134 and 136, the contacts 98 are more efficiently and completely isolated to remove any potential for arcing therebetween or with the conductive member 132.

Returning to FIG. 6, when the actuator assembly 130 is in the ON position, a leading portion of the elbows 114 of the contacts 98 in the second chamber 88 are spaced a distance 176 from the beginning of the ramped surfaces 162. The distance 176 defines a travel range through which the actuator assembly 130 moves in the direction of arrow L before the elbows 114 engage the ramped surfaces 162. As the actuator assembly 130 travels along the travel range defined by distance 176, the contact pads 116 slide along the sides 168 of the conductive member 132. Sliding the contact pads 116 along the sides 168 facilitates removal of carbon and debris that may otherwise build up on the contact pads 116 and conductive member 132. In addition, the travel range defined by distance 176 defines the point at which the contact pads 116 begin to separate from the sides 168 of the conductive member 132.

Figure 7:
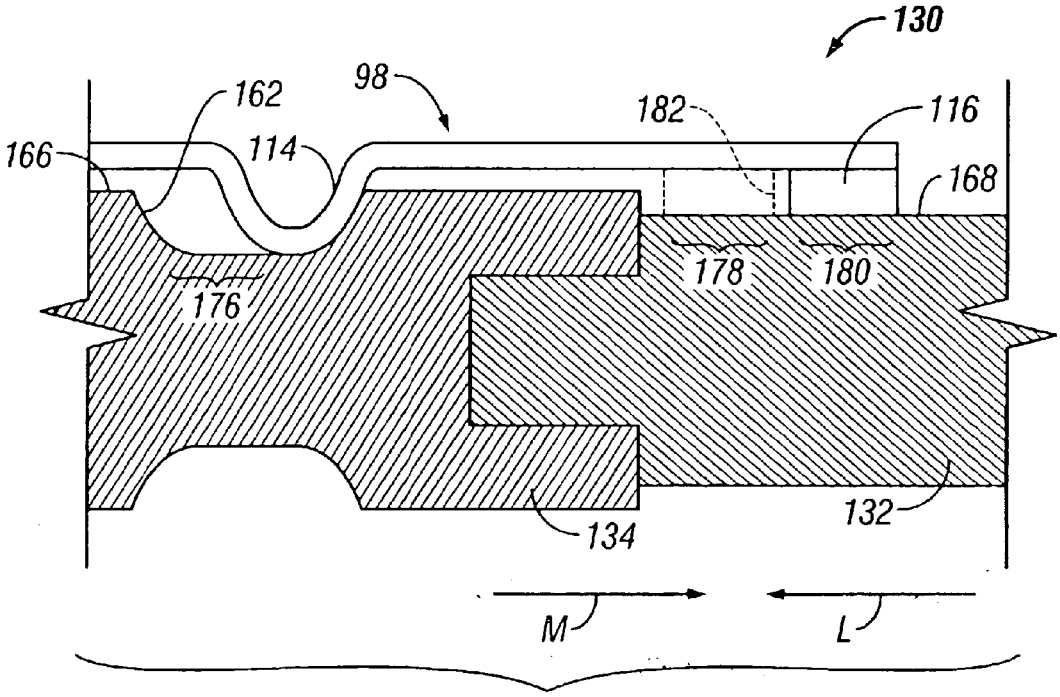
FIG. 7 illustrates a partial view of a contact and actuator mechanism formed in accordance with an embodiment of the present invention.

FIG. 7 illustrates a partial top view of the conductive member 132 and one contact 98. In the position shown in FIG. 7, the actuator assembly 130 is moved to the final engaged position such that the contact pad 116 is located in an operating region 180 on the side 168 of the conductive member 132. When the actuator assembly 130 is advanced toward the rest state, the trailing dielectric member 136 moves in the direction of arrow M and the ramped surface 162 engages elbow 114. At the point where ramped surface 162 initially begins to engage elbow 114, the contact pad 116 has already slid along side 168 to the position 182 denoted in dashed lines which corresponds to a separation region 178 upon the side 168 of the conductive member 132. Once moved to the separation region 178, the contact pad 116 begins to pivot outward away from the sides 168 since the elbow 114 begins to ride up over ramped surface 162 onto the side 166 of the lead dielectric member 134. To the extent that arcing may still occur, the arcing will occur within separation region 178 which is located remote from the operating region 180 on the side 168, thereby further reducing the detrimental effects of arcing upon the final connection made between contact 98 and the conductive member 132. Optionally, the separation region 178 and operating region 180 may partially overlap. Optionally, the lead and trailing dielectric members 134 and 136 may be formed with elbows (not grooves), and the contacts 98 may be formed with grooves (not elbows).

It is understood that the operation described in connection with FIG. 7 occurs at each contact 98 illustrated in FIGS. 5 and 6 within the first and second chambers 86 and 88.

When the electrical switch 60 is in the position shown in FIG. 5, the second contact set 102 is open and the first contact set 100 is closed. A current path is established from the contact tails 106 on the first contact set 100 through the contact pads 116 and the conductive member 132. The contact pads 116 in the second contact set 102 are separated by an air gap and by the trailing dielectric member 136, thereby preventing arcing. When the electrical switch 60 is moved to the position shown in FIG. 6, the switch is in an ON state at which the first and second contact sets 100 and 102 have transitioned between open and closed positions. As the contact pads 116 are wiped along the sides 168 of the conductive member 132, the wiping action cleans any oxides or other non-conductive material and reduces contact resistance. As the contact elbows 114 follow the contour of the sloped surfaces 160 and 162 the contact pads 116 are forced apart thereby quickly increasing the distance between the contact pads 116 and the conductive member 132. The leading and trailing dielectric members 134 and 136 continue along the direction of motion until abutting against corresponding surfaces 172 and 174 (depending upon the direction of motion) of the divider 84 to further interrupt arcing.

Figure 8:
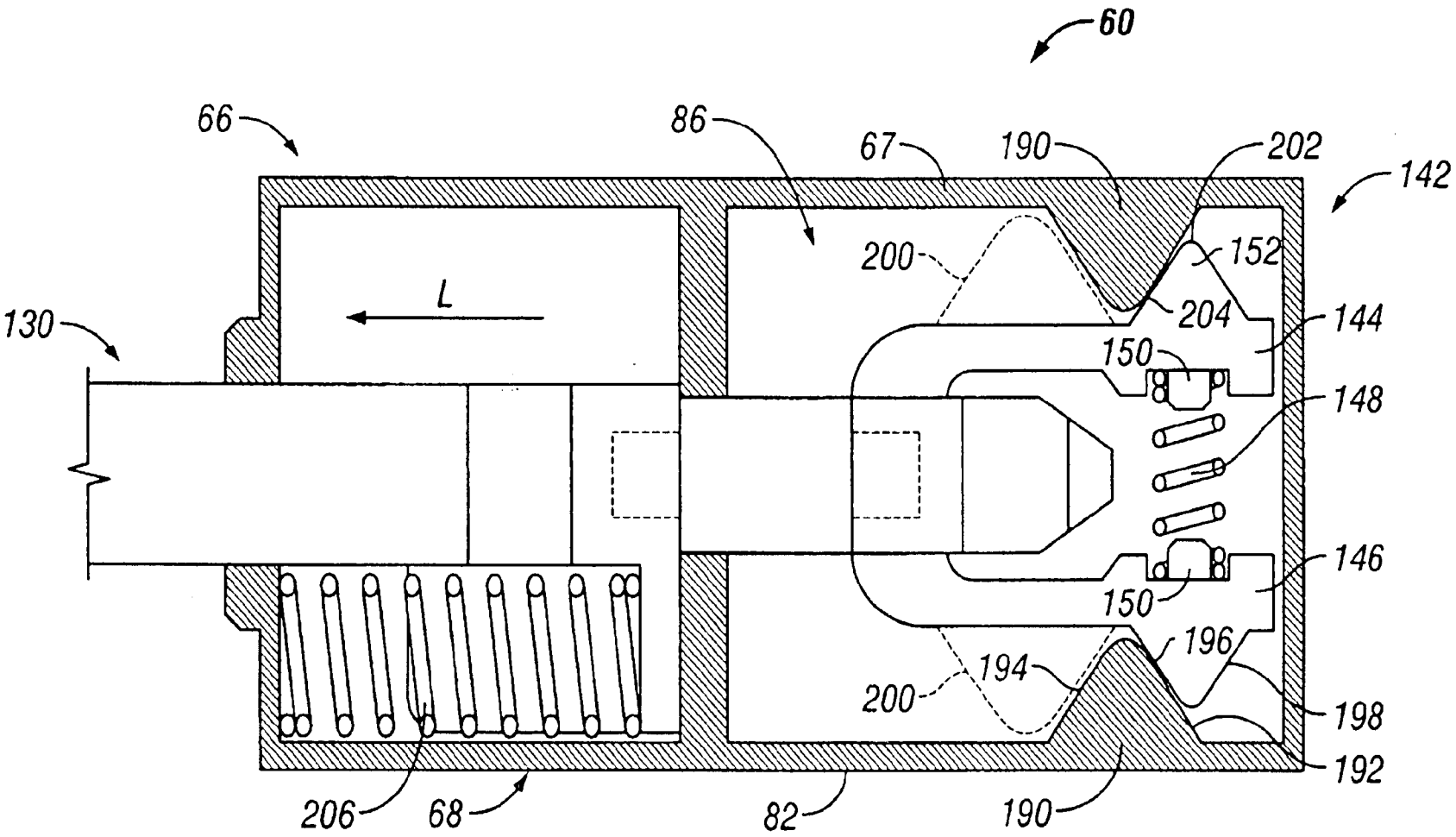
FIG. 8 illustrates a top sectional view of an electrical switch and the trigger assist mechanism therein formed in accordance with an embodiment of the present invention.

FIG. 8 illustrates a partial side sectional view of the electrical switch 60 to better illustrate the trigger advancing mechanism 142 within the first chamber 86. The trigger advancing mechanism 142 includes upper and lower beams 144 and 146 that are joined in a vertical plane and aligned in a U-shape. A spring 148 is compressably held between and retained on posts 150 formed on facing sides of the upper and lower beams 144 and 146. Exterior sides of the upper and lower beams 144 and 146 include raised projections 152 extending outward in opposite directions therefrom. The bottom wall 82 of the housing base 68 and the upper wall 67 of the upper shell 66 are configured with raised projections 190 that face inward towards one another across the first chamber 86. The projections 190 have sloped lead and trailing surfaces 192 and 194 that act upon corresponding lead and trailing surfaces 196 and 198 on the raised projections 152.

The trigger advancing mechanism 142, as shown in FIG. 8, is in a rest position (corresponding to the contact state shown in FIG. 5). When the trigger 62 (FIG. 3) is squeezed, the actuator assembly 130 is moved in the direction of arrow L which causes the raised projections 152 to be biased inward towards one another in order to move past the raised projections 190. The projections 152 are advanced until resting against the trailing sloped surfaces 194 (as shown by dashed lines 200). As the raised projections 152 are advanced from their rest state (as shown in FIG. 8) to their fully engaged state (as shown by shadow line at reference number 200) the leading sloped surfaces 196 of raised projections 152 slide upward along the leading sloped surfaces 192 on the raised projections 190.

When the peaks 202 and 204 of the raised projections 152 and 190, respectively, directly coincide with one another, the upper and lower beams 144 and 146 are fully flexed inward toward one another and the spring 148 is in a fully compressed state. The upper and lower beams 144 and 146 and spring 148 exert a substantial outward force at the point where peaks 202 and 204 align which creates an unstable state within the action of the trigger 62. As the peaks 202 and 204 are advanced beyond this unstable state further in the direction of arrow L the outward forces exerted by the upper and lower. beams 144 and 146 and the spring 148 force the raised projections 152 outward along the trailing sloped surfaces 194 of the projections 190. As the trailing sloped surfaces 198 and 194 of the raised projections 152 and 190 slide along one another, the trigger advancing mechanism 142 pushes the actuator assembly 130 in the direction of arrow L at a very rapid speed. Hence, the trigger advancing mechanism 142 introduces a snapping action into the motion of the trigger 62 (FIG. 3) such that once the actuator assembly 130 is advanced to the unstable state (where peaks 202 and 204 align) the actuator assembly 130 is quickly driven to the final engaged position.

The geometry of the actuator assembly 130, and the elbows 114 and grooves 156 and 158 substantially reduce the potential time for arcing, thereby lengthening the switch life.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical switch, comprising:

a housing having a chamber therein;

a contact assembly movably mounted within said chamber, said contact assembly having an intermediate portion located at an intermediate position along said contact assembly and having at least one contact portion proximate an end of said contact assembly; and an insulated actuator including a conductive member configured to engage said contact portion, said housing slidably retaining said actuator to permit movement of said actuator and conductive member along an actuation path, said actuator engaging said intermediate portion to pivot said contact portion along said arcuate path between engaged and disengaged positions with said conductive member as said actuator moves along said actuation path.

2. The electrical switch of claim 1, wherein said actuator includes an outer dielectric portion overmolded about said conductive member, said outer dielectric portion exposing at least one surface on said conductive member that said contact portion engages.

3. The electrical switch of claim 1, wherein said intermediate portion includes an elbow bent to be directed inward toward said conductive member.

4. The electrical switch of claim l, wherein said contact assembly includes at least two contact arms joined with base portions held firmly in said housing, said contact arms extending along opposed sides of said conductive member, said base portions biasing said contact arms toward said opposed sides of said conductive member.

5. The electrical switch of claim 1, wherein said housing includes first and second contact chambers separated by an insulated divider, said conductive member being movable through said divider between said first and second contact chambers to engage first and second sets of contact arms held in said first and second contact chambers, respectively.

6. The electrical switch of claim 1, wherein said chamber in said housing includes at least one wall with an opening therein, said conductive member being slidable in and out of said opening when said actuator is moved along said actuation path.

7. The electrical switch of claim 1, wherein said contact assembly includes a set of contact arms and said actuator includes an outer dielectric portion that is moved to a position between said contact arms when said set of contact arms disengages said conductive member.

8. The electrical switch of claim 1, wherein said arcuate path is aligned within a contact plane oriented perpendicular to said actuation path.

9. The electrical switch of claim 1, wherein one of said intermediate portion and actuator includes an elbow formed therein and another of said intermediate portion and said actuator includes a groove, said elbow movable in and out of said groove to drive said contact portion along said arcuate path.

10. The electrical switch of claim 1, wherein said actuator includes a groove formed in a side of said actuator proximate said conductive member, said groove engaging said intermediate portion on said contact assembly to pivot said contact portion toward and away from said conductive member as said actuator moves along said actuation path.

11. The electrical switch of claim 1, further comprising:

a switch driver connected to said actuator, said switch driver having a U-shaped body with at least one actuator ramped projection extending outward therefrom, said ramped projection moving along an engagement path aligned with a corresponding mating housing ramped projection provided on said housing; and a spring disposed between legs of said U-shaped body to bias said actuator ramped projection against said housing ramped projection to facilitate movement between said engaged and disengaged positions.

12. The electrical switch of claim 1, wherein said actuator drives said contact along said arcuate path at a first instantaneous rate while said actuator moves simultaneously along said actuator path at a second instantaneous rate that differs from said first instantaneous rate.

13. An electrical switch comprising:

a housing having a chamber therein;

a contact assembly movably mounted within said chamber, said contact assembly having an intermediate portion located at an intermediate position along said contact assembly and having at least one contact portion proximate an end of said contact assembly;

an insulated actuator including a conductive member configured to engage said contact portion, said housing slidably retaining said actuator to permit movement of said actuator and conductive member along an actuation path, said actuator engaging said intermediate portion to pivot said contact portion along said arcuate path between engaged and disengaged positions with said conductive member as said actuator moves along said actuation path; and a U-shaped driver provided on an end of said actuator and a spring disposed between legs of said U-shaped driver, said spring biasing said legs outward against said housing to create a snap action as said contact moves between said engaged and disengaged positions.

14. An electrical switch, comprising:

a housing having a chamber oriented along a longitudinal axis of said housing;

at least one set of contacts pivotally mounted to said housing within said chamber; and an actuator including a conductive member joined with a dielectric member, said contacts having contact ends that are configured to engage said conductive member, said actuator being slidably mounted in said housing to move along said longitudinal axis, said actuator engaging intermediate portions of said contact to rotate said contact ends outward away and disengaged from said conductive member when said actuator slides along said longitudinal axis.

15. The electrical switch of claim 14, wherein said actuator includes lead and trailing dielectric members joined to opposite ends of said conductive member, said lead and trailing dielectric members isolating said conductive member from first and second sets of contacts, respectively, when corresponding first and second sets of contacts are disengaged from said conductive member.

16. The electrical switch of claim 14, wherein said intermediate portions include elbows bent toward said actuator and said dielectric member includes ramped surfaces that engage said elbows remote from said contact ends to rotate said contact ends outward away from said conductive member.

17. The electrical switch of claim 14, wherein each of said contacts includes a body portion firmly secured to said housing and an arm extending along said chamber, said arms including said intermediate portions and said contact ends, said arms being biased inward toward one another to engage said conductive member when said conductive member is positioned between said arms.

18. An electrical switch, comprising:

a housing having a chamber oriented along a longitudinal axis of said housing;

a contact pivotally mounted to said housing within said chamber;

an actuator including a conductive member joined with a dielectric member, said actuator being slidably mounted in said housing to move along said longitudinal axis, wherein said contact includes an intermediate elbow formed therein and remote from an end of said contact, said dielectric member including a groove positioned to align with said elbow when said dielectric member is in a first position, said groove driving said elbow outward when said dielectric member is moved to a second position to pivot said end of said contact outward away from said conductive member.

19. An electrical switch, comprising:

a housing having a chamber oriented along a longitudinal axis of said housing;

at least one set of contacts pivotally mounted to said housing within said chamber;

an actuator including a conductive member joined with a dielectric member, said contacts having contact ends that are configured to engage said conductive member, said actuator being slidably mounted in said housing to move along said longitudinal axis, said actuator engaging intermediate portions of said contacts to rotate said contact ends outward away and disengaged from said conductive member when said actuator slides along said longitudinal axis; and an actuator including lead and trailing dielectric members joined to opposite ends of said conductive member, said lead and trailing dielectric members isolating said conductive member from first and second sets of contacts, respectively, when corresponding first and second sets of contacts are disengaged from said conductive member.

20. An electrical switch comprising:

a housing having a chamber therein;

a contact assembly movably mounted within said chamber, said contact assembly having an intermediate portion located at an intermediate position along said contact assembly and having at least one contact portion proximate an end of said contact assembly;

an insulated actuator including a conductive member configured to engage said contact portion, said housing slidably retaining said actuator to permit movement of said actuator and conductive member along an actuation path, said actuator engaging said intermediate portion to pivot said contact portion along said arcuate path between engaged and disengaged positions with said conductive member as said actuator moves along said actuation path;

a U-shaped driver provided on an end of said actuator and a spring disposed between legs of said U-shaped driver, said spring biasing said legs outward against said housing to create a snap action as said contact moves between said engaged and disengaged positions; and a U-shaped driver provided on an end of said actuator and a spring disposed between legs of said U-shaped driver, said spring biasing said legs outward against said housing to create a snap action as said contact moves between said engaged and disengaged positions.

* * * * *